US006584800B1

(12) United States Patent
Roth et al.

(10) Patent No.: US 6,584,800 B1
(45) Date of Patent: Jul. 1, 2003

(54) METHOD AND SYSTEM FOR USE WITH A CONSUMABLE BEVERAGE

(76) Inventors: Hank Roth, 42 Tremont St., Duxbury, MA (US) 02332; Donna Roth, 42 Tremont St., Duxbury, MA (US) 02331

( * ) Notice: Subject to any disclaimer, the term of this patent is extended or adjusted under 35 U.S.C. 154(b) by 0 days.

(21) Appl. No.: 10/212,976

(22) Filed: Aug. 5, 2002

Related U.S. Application Data

(62) Division of application No. 10/128,022, filed on Apr. 23, 2002.

(51) Int. Cl.[7] ..... F25D 3/08

(52) U.S. Cl. ..... 62/457.3; 220/506; 220/528

(58) Field of Search ..... 62/457.3; 220/506, 220/528, 23.83, 23.85, 23.87, 23.89

(56) References Cited

U.S. PATENT DOCUMENTS

| | | | | |
|---|---|---|---|---|
| 4,732,303 A | | 3/1988 | Wang | |
| 5,009,083 A | | 4/1991 | Spinos | |
| 5,065,909 A | | 11/1991 | Pino et al. | |
| 5,085,336 A | | 2/1992 | Lynd | |
| 5,129,238 A | | 7/1992 | Schwartz et al. | |
| 5,242,079 A | | 9/1993 | Stephens et al. | |
| D351,761 S | | 10/1994 | Feer | |
| D358,301 S | | 5/1995 | Brown et al. | |
| 5,456,090 A | * | 10/1995 | McCoy | 62/372 |
| 5,507,156 A | * | 4/1996 | Redmon | 62/400 |
| 5,597,087 A | * | 1/1997 | Vinarsky | 220/482 |
| 5,609,039 A | * | 3/1997 | Green et al. | 62/457.3 |
| 5,609,090 A | | 3/1997 | Weyer | |
| D382,170 S | | 8/1997 | Green | |
| D384,584 S | | 10/1997 | Kong | |
| D387,621 S | | 12/1997 | Sullivan et al. | |
| D389,365 S | | 1/1998 | Lipson | |
| D401,106 S | | 11/1998 | Valentinitsch | |
| 6,050,433 A | | 4/2000 | Russell | |
| 6,123,065 A | * | 9/2000 | Teglbjarg | 126/263.09 |
| D448,971 S | | 10/2001 | Hughes | |
| 6,415,624 B1 | * | 7/2002 | Connors et al. | 62/457.3 |

* cited by examiner

*Primary Examiner*—William E. Tapolcai
*Assistant Examiner*—Mohammad M. Ali
(74) *Attorney, Agent, or Firm*—Volpe and Koenig, P.C.

(57) ABSTRACT

A system for use with a consumable beverage includes a container having a mouth. A lid is detachably engaged with the container. A collar is adapted to be seated in the mouth of the container. The collar defines an opening therein. A thermal energy storing member is detachably engagable with the opening in the collar and/or the lid. A collar for supporting an end of a thermal energy storing member; a lid for a container adapted to engage a thermal energy storing member; and method of providing a chilled consumable beverage are each separately detailed herein.

14 Claims, 3 Drawing Sheets

FIG. 1
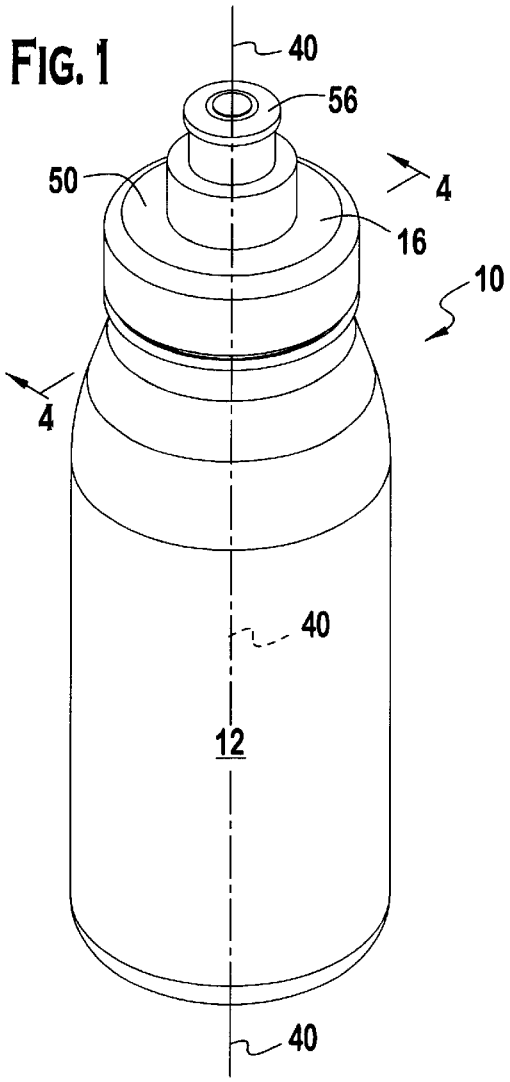
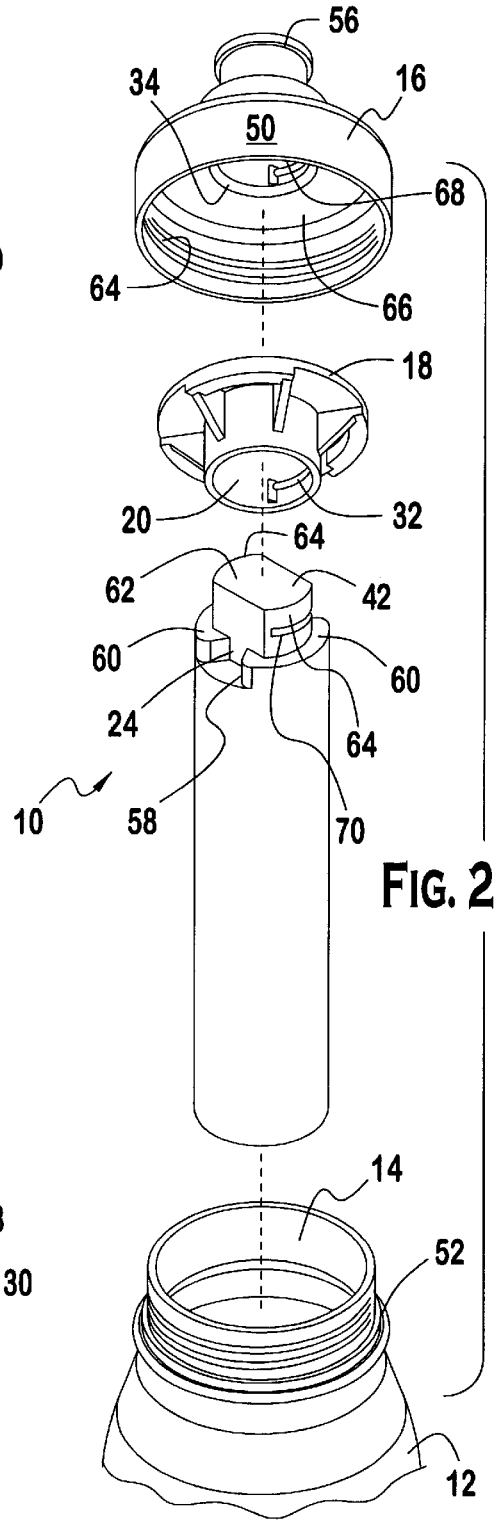
FIG. 2
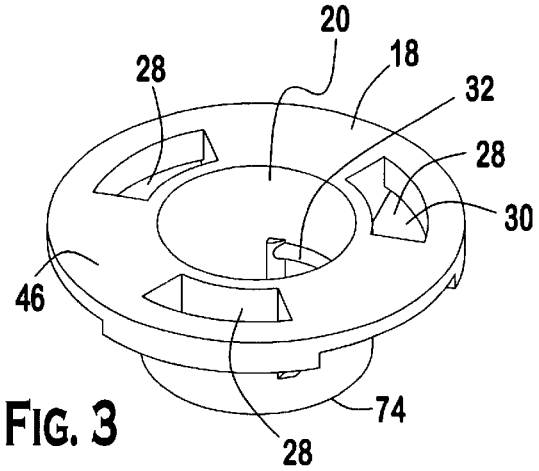
FIG. 3

FIG. 4
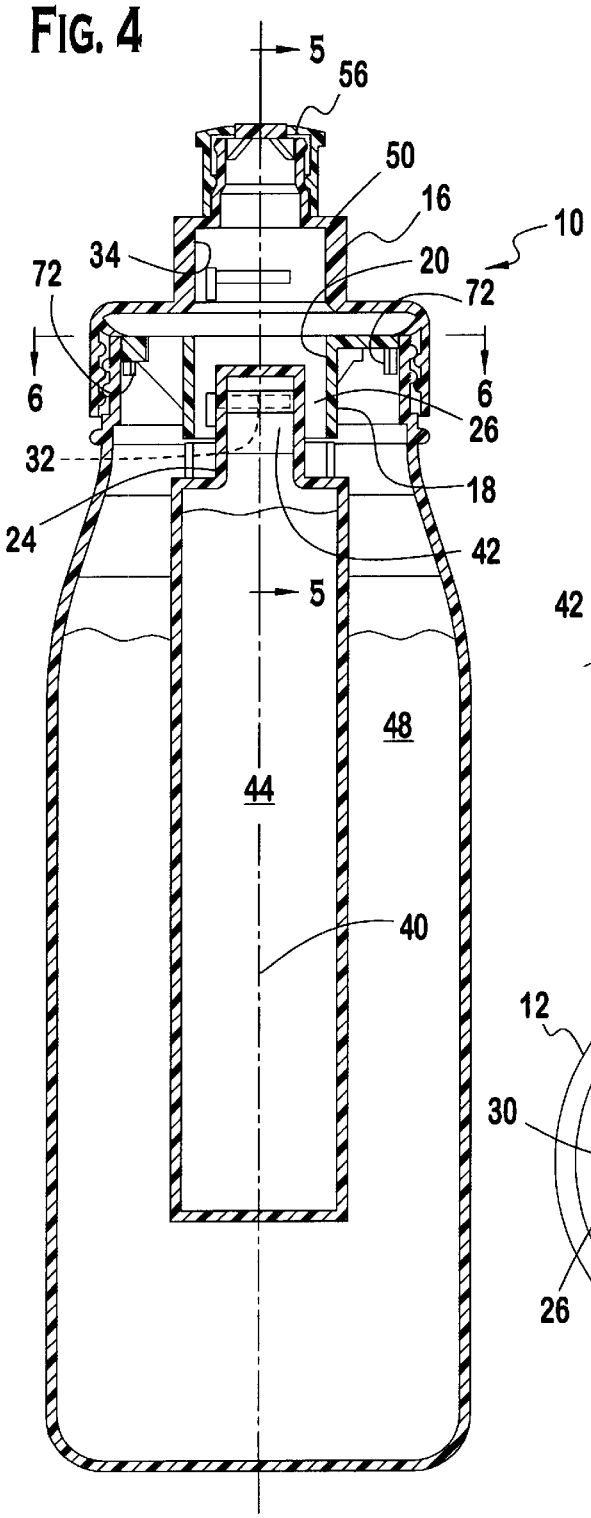
FIG. 5
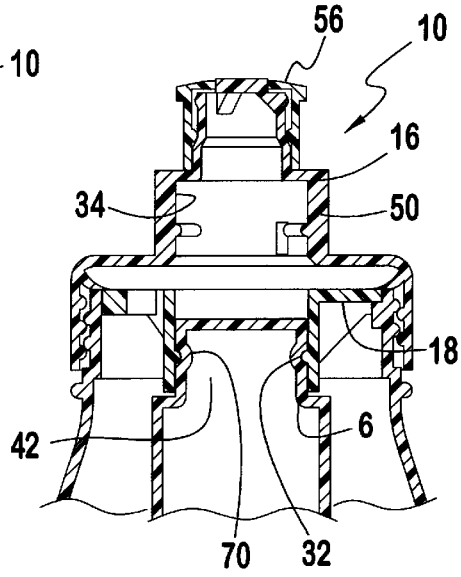
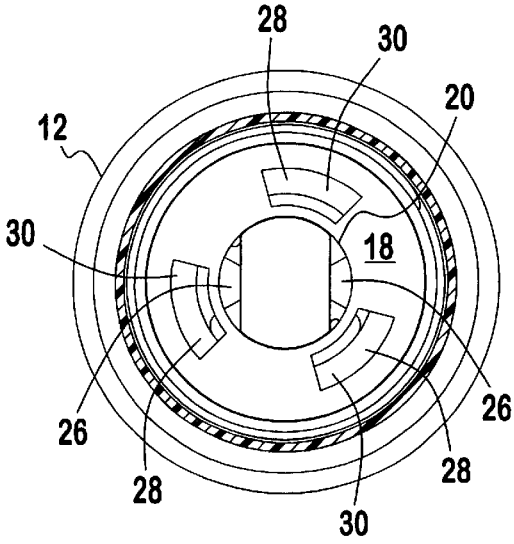
FIG. 6

FIG. 7
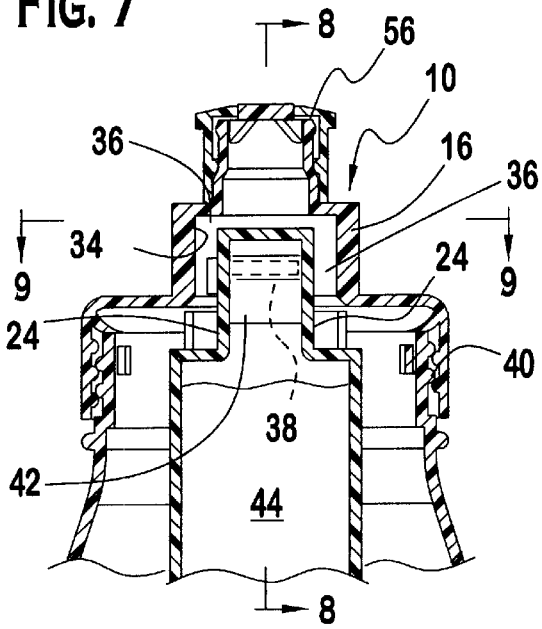
FIG. 8
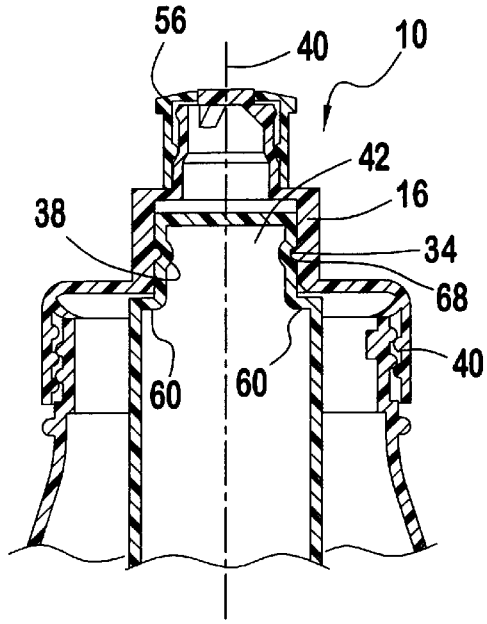
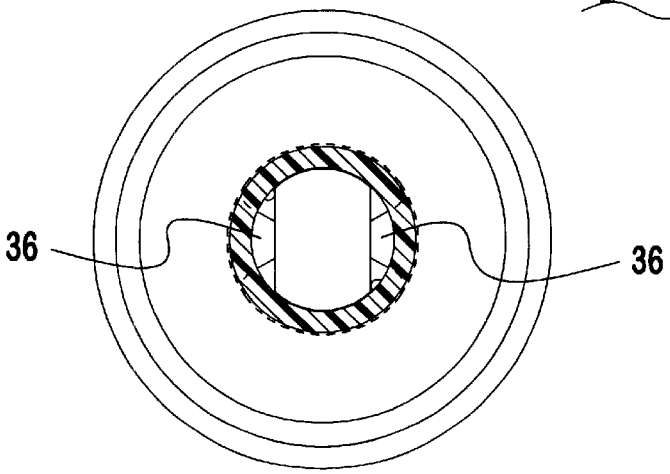
FIG. 9

METHOD AND SYSTEM FOR USE WITH A CONSUMABLE BEVERAGE

CROSS REFERENCE TO RELATED APPLICATION

This application claims priority to and is a division of U.S. patent application Ser. No. 10/128,022, entitled "Method and System for use with a Consumable Beverage", filed on Apr. 23, 2002, which is hereby incorporated by reference herein as if fully set forth.

BACKGROUND

The present invention is directed to devices and methods for enhancing the quality of consumable beverages and, more specifically, to a system for use with a consumable beverage and a method of providing a chilled consumable beverage. Beverages are typically chilled using ice cubes to maintain a desired beverage temperature. However, the use of ice cubes results in the dilution of the beverage due to the introduction of water resulting from the melting of ice cubes. Additionally, some people will spill beverages or find filled beverage bottles to be unwieldy due to a sudden shift in the bottle's center of mass caused by unexpected movement of ice cubes when the beverage container is tilted.

To overcome this difficulty, re-freezable inserts have been developed for use with drink bottles. These re-freezable inserts can be placed in drink bottles to maintain a beverage in a chilled condition. However, a method for satisfactorily securing a re-freezable insert in a drink bottle has not been developed.

Clearly, what is needed is a method and system for use with a consumable beverage that securely mounts a thermal energy storing member within a container; that preferably mounts the thermal energy storing member to either a collar or a lid of the container; that preferably incorporates an easy to operate twist lock connection for securing the thermal energy storing member; that preferably allows easy removal of the thermal energy storing member without requiring the removal of other system components; and that is that fun and easy to use by children.

SUMMARY

One embodiment of the present invention is directed to a system for use with a consumable beverage. The system includes a container having a mouth. A lid is detachably engagable with the container. A collar is adapted to be seated in the mouth of the container. The collar defines an opening therein. A thermal energy storing member is detachably engagable with the opening in the collar and/or the lid.

A separate embodiment of the present invention is directed to a collar for supporting an end of a thermal energy storing member proximate to the mouth of a consumable beverage container. The collar includes a body configured to complement a shape of the mouth. The body defines an opening therethrough. The opening is adapted to engage the end of the thermal energy storing member.

A separate embodiment of the present invention is directed to a lid for a container adapted to engage a thermal energy storing member. The lid includes a body adapted to engage the container and having an inner surface. The inner surface is adapted to receive at least a portion of the thermal energy storing member therein. The inner surface is adapted to form, in combination with the thermal energy storing member, a liquid passageway along the thermal energy storing member and through the body.

A separate embodiment of the present invention is directed to a method of providing a chilled consumable beverage. The method includes: providing a container having a mouth; placing a consumable beverage in the container; chilling a thermal energy storing member; and inserting the chilled thermal energy storing member into the container such that the chilled energy storing member contacts the consumable beverage to cool to the consumable beverage within the container, the chilled energy storing member being securely positionable within the container via a collar seated proximate to the mouth of the container.

A separate embodiment of the present invention is directed to a system for use with a consumable beverage. The system includes a container having a mouth. A lid detachably engagable with the container. A thermal energy storing member detachably engagable with the lid via a twist lock mechanism.

BRIEF DESCRIPTION OF THE SEVERAL VIEWS OF THE DRAWINGS

The foregoing summary, as well as the following detailed description of the preferred embodiment of the present invention will be better understood when read in conjunction with the appended drawings. For purposes of illustrating the invention, there are shown in the drawings, an embodiment which is presently preferred. It is understood, however, that the invention is not limited to the precise arrangement and instrumentality shown. In the drawings:

FIG. 1 is a perspective view of a system for use with a consumable beverage according to the preferred embodiment of the present invention;

FIG. 2 is an exploded partial view of the system of FIG. 1 illustrating a lid, a collar, a thermal energy storing member, and a top of a container;

FIG. 3 is an enlarged perspective view of the collar of FIG. 2;

FIG. 4 is a cross-sectional view of the system of FIG. 1 as taken along the line 4—4 of FIG. 1 illustrating the thermal energy storing member secured in an opening in the collar;

FIG. 5 is a cross-sectional view of the system of the FIG. 4 as taken along the line 5—5 of FIG. 4 illustrating the engagement between the thermal energy storing member and a thread within the opening in the collar;

FIG. 6 is a cross-sectional view of the system of FIG. 4 as taken along the line 6—6 of FIG. 4 and illustrates a top plan view of the combination collar and thermal energy storing member when seated within the mouth of the container;

FIG. 7 is a view similar to that of FIG. 5 illustrating the system of FIG. 4 with the collar removed so that the thermal energy storing member directly engages the lid;

FIG. 8 is a cross-sectional view of the system of FIG. 7 as taken along the line 8—8 of FIG. 7 illustrating the engagement between the thermal energy storing member and a thread within the lid; and FIG. 9 is a cross-sectional view of the system of FIG. 7 as taken along the line 9—9 of FIG. 7 illustrating a top plan view of the thermal energy storing member when engaged with a portion of the lid.

DETAILED DESCRIPTION OF THE PREFERRED EMBODIMENT

Certain terminology is used in the following description for convenience only and is not limiting. The words "right,"

"left," "upper," and "lower" designate directions in the drawings to which reference is made. The words "inwardly" and "outwardly" refer to directions toward and away from, respectively, the geometric center of the system for use with a consumable beverage and designated parts thereof. The terminology includes the words above specifically mentioned, derivatives thereof, and words of similar import. Additionally, the words "a" and "one" are defined as including one or more of the referenced item unless specifically stated otherwise.

Referring to FIGS. 1–9, wherein like numerals indicate like elements throughout, a preferred embodiment of a system for use with a consumable beverage is shown and generally designated as 10. Briefly stated, the system includes a container 10 for enclosing a beverage 48 and a thermal energy storing member 44 therein to maintain the beverage 48 in either a chilled or heated condition. The thermal energy storing member 44 is preferably securable to either one of a collar 18 (further described below) or a lid 16 (further described below) via a convenient twist lock feature that allows the thermal energy member 44 to be easily disengaged from either component so that the remaining portions of the system 10 can used with beverages while the thermal energy storing member 44 is being heated or cooled. Additionally, the system 10 can be used with one of multiple interchangeable thermal energy storing members 44, to avoid delays caused by waiting for a single thermal energy storing member 44 to re-freeze or re-heat prior to continued use of the system 10.

The system 10 and its component parts are preferably formed from a sturdy, non-reactive, durable material, such as a suitable polymer. However, those of ordinary skill in the art will appreciate from this disclosure that the system 10 and its various components can be formed from any materials suitable for use with beverages. The thermal energy storing member 44 preferably contains a gelatinous material that is formed of re-freezable material and/or re-heatable material, such as the non-toxic materials used in gel packs and the like.

Referring to FIGS. 1 and 2, the system 10 for use with a consumable beverage 48 includes a container 12 having a mouth 14. While it is preferred that the container 12 is part of a sports bottle, those of ordinary skill in the art will appreciate from this disclosure that any type of container 12 can be used with the system 10 of the present invention. Similarly, while it is preferred that the mouth 14 of the container 12 is generally circularly shaped, those of ordinary skill in the art will appreciate from this disclosure that the mouth 14 can have any shape without departing from the scope of the present invention.

The container 12 preferably has at least one thread 52 positioned generally around a substantial portion of a perimeter of the container 12 proximate to the mouth 14 for engaging a lid 16. Alternatively, the container 12 can engage the lid 16 via a snap fit without departing from the scope of the present invention.

As best shown in FIG. 4, the lid 16 is preferably detachably engagable with the container 12 by engaging at least one lid thread 54 with the at least one lid thread 52. The least one lid thread 54 generally extends substantially around an inner surface of the lid 16 for detachably engaging the container 12. The lid 16 preferably includes a pull top 56 to allow the container 12 to be sealed when not in use.

As shown in FIGS. 4, 5, 7, and 8, the lid 16 is formed by a lid body 50 that preferably has a tube section 34 for receiving a least a portion of the thermal energy storing member 44 therein. The tube section 34 is preferably generally cylindrical shaped.

The thermal energy storing member 44 can be attached to either one of the lid 16 or the collar 18 (further described below). The connection between the thermal energy storing member 44 and the lid 16 is as follows. Referring to FIGS. 2, 4, and 7, the thermal energy storing member 44 preferably has at least one groove 24 adapted to form, in combination with the tube section 34, a liquid passageway 36 through the lid 16 when the collar 18 is not used with the system 10. Grooves 24 are preferably located on opposing sides of the top end 62 of the thermal energy storing member 44. Each groove 24 preferably extends generally inwardly into the thermal energy storing member to form a flared section 58.

Referring to FIG. 8, when the thermal energy storing member 44 is engaged with the lid 16, a shoulder 60 of the thermal energy storing member 44 preferably abuts, or is proximate to, the bottom end of the tube section 34. The flared section 58 of the groove(s) 24 allows beverage 48 to flow from the inside of the container 12 through the flared section 58 and through tube section 34 (i.e., through the liquid passageway 26).

As best shown in FIGS. 2, 7, and 8 the upper end 62 of the thermal energy storing member 44 preferably has a generally oblong shape to allow opposing ends 64 to engage the inner surface of the tube section 34 while still leaving an opening that forms part of the liquid passageway 26 through which the beverage 48 can flow out of the container 12. Thus, the lid inner surface 66 is adapted to receive at least a portion of the thermal energy storing member 44 and is adapted to form, in combination with the thermal energy storing member 44, the liquid passageway 26 along the thermal energy storing member 44 and through the lid body 50. The routing of the liquid passageway 24 along the thermal energy storing member 44 results in the more efficient cooling (or heating) of the beverage 48 just prior to consumption thereof.

It is preferable that at least one thread 68 is positioned within the tube section 34 to engage the thermal energy storing member 44. The opposing ends 64 of the top portion 62 of the thermal energy storing member 44 preferably have recesses 70 that are complementarily shaped to receive the tube section thread 68 of the lid 16. Thus, the tube section one thread 68 allows the inner surface of the lid 16 to detachably engage the thermal energy storing member 44 using a twist lock mechanism. This allows for quick and secure mounting of the thermal energy storing member 44. Additionally, this secure positioning of the thermal energy storing member avoids excessive shifting of the container's center of mass when the drink bottle is tilted.

As mentioned above, the thermal energy storing member 44 can also be secured to the collar 18. Referring to FIGS. 2–4, the collar 18 is adapted to be seated in the container mouth 14. Supports 72 are preferably positioned on a inner surface of the container 12 proximate to the mouth 14 to brace the bottom side of the collar 18. This allows the collar 18 to be slid inside of the mouth 14 and braced by supports 72 such that the top surface of the collar 18 is generally aligned with the upper edge of the mouth 14. The collar 18 has a body 46 defining an opening 20 therein which is adapted to engage the end 62 of the thermal energy storing member 44. The opening 20 preferably, but not necessarily, has a generally cylindrical shape. The collar body 46 complements the shape of the mouth 14.

The thermal energy storing member 44 preferably has at least one groove 24 adapted to form, in combination with the collar 18, a liquid passageway 24 though the collar 18. Referring to FIG. 5, when the thermal energy storing member 44 is engaged with the collar, the shoulder 60 of the thermal energy storing member 44 preferably abuts, or is located proximate to, the lower edge 74 of the collar 18. The positioning of the groove 24 generally below the shoulder 60 of the thermal energy storing member 44 allows the beverage 48 to pass through the groove 24 underneath the lower edge 74 of the collar 18 and through the liquid passageway 24. As the beverage 48 travels along the thermal energy storing member 44, the beverage 48 is chilled (or heated) to provide enhanced enjoyment to a drinker. The routing of the liquid passageway 24 along the thermal energy storing member 44 results in the more efficient cooling (or heating) of the beverage 48 just prior to consumption thereof.

Referring to FIGS. 3 and 6, the collar 18 preferably defines at least one vent 28 therethrough to create a second liquid passageway 30. The second liquid passageway 30 provides improved beverage flow 48 within the container. The vent(s) 28 is preferably spaced from the thermal energy member 44.

It is preferred that at least one thread 32 is positioned within the collar opening 20 that is adapted to engage the thermal energy storing member 44. The engagement between the collar thread 32 and the recess 70 in the thermal energy storing member 44 allows for a twist lock connection between the thermal energy storing member 44 and the collar that provides a secure placement of the thermal energy storing member 44 within the container 12. This prevents the center of gravity of a full drinking system 10 from suddenly shifting due to the movement of the energy storing member 44 therein. Additionally, the twist lock engagement between the thermal energy storing member 44 and the collar 18 provides for quick and easy removal and replacement of the thermal energy storing member 44 when desired. When the thermal energy storing member 44 is twisted and locked in position relative to the collar 18; the collar 18 is seated generally within the mouth 14 of the container; and the lid 16 is secured over the mouth 14 of the container 12, the energy storing member 44 and the collar 18 are secured in position. Thus, the collar 18 is securable in position when seated in the mouth 14 and the lid 16 is detachably engaged with the container 12.

As is clear from the above description of the engagement between the thermal energy storing member 44 and either the lid 16 or the collar 18, the thermal energy storing member 44 is detachably engagable with the collar 18 and/or the lid 16. It is preferably that the end 62 of the thermal energy storing member 44 that is attached to the collar 18 or the lid 16 is alignable along the longitudinally axis 40 of the container 12.

The present invention also includes a method of providing a chilled consumable beverage. The method includes the steps of providing a container 12 having a mouth 14 and placing a consumable beverage 48 in the container 12. The method also includes chilling a thermal energy storing member 44 and inserting the chilled thermal energy storing member 44 into the container 12 such that the chilled thermal energy storing member 44 contacts the consumable beverage 48 to cool the beverage 48 enclosed within the container 12. The chilled thermal energy storing member 44 is securely positioned within the container 12 via a collar 18 seated proximate to the mouth 14 of the container 12. The method of the present invention preferably includes securing a lid 16 over the mouth 14 that also secures the collar 18 in the seated position and inserting the chilled thermal energy storing member 44 within the opening 20 in the collar 18 such that a liquid passageway 26 along the chilled thermal energy storing member 44 and through the collar 18 is formed. The method of the present invention preferably includes providing a collar 18 having at least one vent 28 therethrough to form a second liquid passageway 30 through the collar 18. The at least one vent 28 is preferably spaced from the opening 20.

Referring to FIGS. 1–9, one embodiment of the system 10 for use with a consumable beverage 48 operates as follows. The lid 16 is removed from the container 12 and the combination collar 18 and thermal energy storing member 44 is removed from the container 12. Once the combination collar 18 and thermal energy storing member 44 are removed from the container 12, the thermal energy storing member 44 is twisted to disengage the recesses 70 from the collar thread 32 to allow to the thermal energy storing member 44 to be separated from the collar 18.

Then, the thermal energy storing member 44 is heated or chilled as desired and the container 12 is filled with a consumable beverage 48 and the heated or chilled thermal energy storing member 44 is engaged with one of the collar 18 or the lid 16 to maintain a desired beverage temperature. To attach the thermal energy storing member 44 to the collar 18, the upper end 62 of the thermal energy storing member 44 is inserted into the opening 20 of the collar 18 and twisted to engage the recesses 70 with the collar thread 32. This twist lock feature securely positions the thermal energy storing member 44 relative to the collar 18 and relative to the container 12.

Once the thermal energy storing member 44 is attached to the collar 18, the combination is inserted into the mouth 14 of the container 12 with the underside of the collar 18 resting on supports 72. Then, the lid 16 is secured over the mouth 14 to sandwich the collar 18 in position between the supports 72 and an inner surface of the lid 16.

Alternatively, when the thermal energy storing member 44 is attached to the lid 16, the upper end 62 of the thermal energy storing member 44 is inserted into the tube section 34 of the lid 16 and twisted to engage the recesses 70 with the lid thread 68. Thus, the thermal energy storing member 44 uses the advantageous twist lock securing feature regardless of whether the thermal energy storing member 44 is secured to the collar 18 or to the lid 16.

The liquid passageways formed by the groove 24 of the thermal energy storing member 44 and one of the collar 18 and the lid 16 allow for beverage 48 to flow along the thermal energy storing member 44 toward the pull top 56 of the container 12 and enhances the heat transfer efficiency of the system. Additionally, by securely positioning the thermal energy storing member 44 along the longitudinal axis 40 of the container 12, sudden shifts in the center of gravity of the system 10 due to tilting of the container are reduced. This simplifies the handling of the container 12. Furthermore, the efficient and simple twist lock mechanism for securing the thermal energy storing member 44 allows the cooling (or heating) element of the system 10 to be removed while still allowing the system 10 to be used for drinking. Multiple thermal energy storing members 44 can be used with a single lid 16 and container 12 combination.

It is recognized by those skilled in the art, that changes may be made to the above described embodiment of the invention without departing from the broad inventive concept thereof. It is understood, therefore, that this invention is not limited to the particular embodiment disclosed, but is intended to cover to all modifications which are within the spirit and scope of the invention as defined by the appended claims.

We claim:

1. A lid for a container adapted to engage a thermal energy storing member, the lid comprising:

a body defining an opening and adapted to engage the container and having an inner surface, a portion of the inner surface surrounds the opening and is adapted to detachably receive at least a portion of the thermal energy storing member therein, the portion of the inner surface also being adapted to form, in combination with the thermal energy storing member, a liquid passageway through the body to the opening, wherein the liquid passageway is defined by at least part of the portion of the inner surface and a surface of the thermal energy storing member; and wherein the inner surface is adapted to form, in combination with the thermal energy storing member, a second liquid passageway through the body to the opening, the second liquid passageway being defined by another portion of the inner surface and another surface of the thermal energy storing member.

2. The lid of claim 1, wherein the inner surface defines a tube section adapted to receive the thermal energy storing member therein and having at least one thread for detachably engaging the thermal energy storing member.

3. The lid of claim 1, further comprising the thermal energy storing member detachably attached to the portion of the body, the thermal energy storing member, while engaged with the portion of the body, cooperates with the portion of the inner surface to form the liquid passageway.

4. The lid of claim 1, wherein the liquid passageway and the second liquid passageway are generally oppositely located with respect to a center of the body.

5. A lid for a container adapted to engage a thermal energy storing member, the lid comprising:

a body adapted to engage the container and having inner and outer surfaces and defining an opening;

a pull top disposed on the outer surface of the body and capable of sealing the opening;

the inner surface defining a tube section around the opening, the tube section being adapted to detachably receive at least a portion of the thermal energy storing member therein, the tube section being adapted to form, in combination with the thermal energy storing member, a liquid passageway through the body to the pull top, wherein the liquid passageway is defined by a surface of the tube section and a surface of the thermal energy storing member; and wherein the tube section is adapted to secure the thermal energy storing mechanism therein using a twist lock mechanism.

6. The lid of claim 5, wherein the pull top is generally centrally aligned on the outer surface of the body.

7. The lid of claim 5, wherein the twist lock mechanism allows the thermal energy storing member to be engaged with the lid by inserting the thermal energy storing member in the tube section and laterally rotating the thermal energy storing member.

8. The lid of claim 5, wherein the lateral rotation of the thermal energy storing member is less than seven hundred twenty (720) degrees.

9. The lid of claim 5, wherein the lateral rotation of the thermal energy storing member is less than five hundred forty (540) degrees.

10. The lid of claim 5, wherein the lateral rotation of the thermal energy storing member is less than three hundred sixty (360) degrees.

11. The lid of claim 10, wherein the tube section is adapted to form, in combination with the thermal energy storing member, a second liquid passageway through the body, the second liquid passageway being defined by another part of the tube section and by another surface of the thermal energy storing member.

12. The lid of claim 11, wherein the liquid passageway and the second liquid passageway are generally oppositely located with respect to the opening.

13. The lid of claim 5, further comprising the thermal energy storing member detachably attached to the tube section, the thermal energy storing member, when engaged with the tube section, cooperates with the body to form the liquid passageway.

14. A lid for a container adapted to engage a thermal energy storing member, the lid comprising:

a body adapted to engage the container and having inner and outer surfaces and defining an opening;

a pull top disposed on the outer surface of the body and capable of sealing the opening;

the inner surface defining a tube section around the opening, the tube section detachably receives at least a portion of the thermal energy storing member therein, the tube section forms, in combination with the thermal energy storing member, a liquid passageway through the body to the pull top, wherein the liquid passageway is defined by a surface of the tube section and a surface of the thermal energy storing member; and the thermal energy storing member detachably attached to the tube section via a twist lock mechanism, the thermal energy storing member, when engaged with the tube section, cooperates with the tube section to form the liquid passageway, wherein the twist lock mechanism allows the thermal energy storing member to be engaged with the body by inserting the thermal energy storing member into the tube section and then laterally rotating the thermal energy storing member.

* * * * *